US005675280A

United States Patent [19]

Nomura et al.

[11] Patent Number: 5,675,280

[45] Date of Patent: Oct. 7, 1997

[54] SEMICONDUCTOR INTEGRATED CIRCUIT DEVICE HAVING BUILT-IN STEP-DOWN CIRCUIT FOR STEPPING DOWN EXTERNAL POWER SUPPLY VOLTAGE

[75] Inventors: Yukihiro Nomura, Kawasaki; Shigemasa Ito, Kasugai, both of Japan

[73] Assignee: Fujitsu Limited, Kawasaki, Japan

[21] Appl. No.: 654,786

[22] Filed: May 28, 1996

Related U.S. Application Data

[63] Continuation of Ser. No. 260,915, Jun. 15, 1994, abandoned.

[30] Foreign Application Priority Data

Jun. 17, 1993 [JP] Japan ..... 5-146125

[51] Int. Cl.[6] ..... G05F 3/02

[52] U.S. Cl. ..... 327/538; 327/540; 327/545

[58] Field of Search ..... 327/530, 538, 327/540, 541, 543, 546, 527, 545, 325

[56] References Cited

U.S. PATENT DOCUMENTS

| | | | |
|---|---|---|---|
| 3,986,048 | 10/1976 | Okada et al. | 327/530 |
| 4,485,313 | 11/1984 | Nagano | 327/530 |
| 4,873,458 | 10/1989 | Yoshida | 327/530 |
| 4,964,084 | 10/1990 | Jung et al. | 327/537 |
| 5,049,806 | 9/1991 | Urakawa et al. | 327/537 |
| 5,051,615 | 9/1991 | Rosenthal | 327/50 |
| 5,077,518 | 12/1991 | Han | 327/541 |
| 5,081,380 | 1/1992 | Chen | 327/262 |
| 5,109,187 | 4/1992 | Guliani | 327/530 |
| 5,151,611 | 9/1992 | Rippey | 327/525 |
| 5,173,656 | 12/1992 | Seevinck et al. | 327/537 |
| 5,394,037 | 2/1995 | Josephson et al. | 327/530 |
| 5,416,438 | 5/1995 | Shibata | 327/552 |
| 5,448,199 | 9/1995 | Park | 327/546 |

*Primary Examiner*—Terry Cunningham
*Attorney, Agent, or Firm*—Staas & Halsey

[57] ABSTRACT

An LSI device can provide a desired constant value of a step-down voltage even if there are variations due to the production processes and a stable characteristic of internal circuits is obtained. The LSI device such as a DRAM includes a first input terminal of the high-voltage-side external supply voltage, a constant current source and a second input terminal of the low-voltage-side supply voltage. Further, the device includes a circuit which makes a voltage between two terminals variable due to the disconnection of each fuse. A step-down circuit is formed by the constant current source and the load circuit and provides a step-down voltage $V_B$ for stepping down the external supply voltage $V_{CC}$.

7 Claims, 9 Drawing Sheets

Fig. 7

| FUSE 35 | FUSE 36 | FUSE 37 | VOLTAGE AT NODE 85 |
|---|---|---|---|
| ○ | ○ | ○ | $3V_{THE}$ |
| ○ | ○ | × | $3V_{THE} + V_{THE}$ |
| ○ | × | × | $3V_{THE} + 2V_{THE}$ |
| × | × | × | $3V_{THE} + 3V_{THE}$ |

○ : NOT DISCONNECTED

× : DISCONNECTED

Fig.8

| FUSE 48 | FUSE 49 | FUSE 50 | FUSE 51 | FUSE 52 | FUSE 53 | FUSE 54 | FUSE 55 | FUSE 56 | VOLTAGE BETWEEN NODE 86 AND NODE 85 |
|---|---|---|---|---|---|---|---|---|---|
| ○ | ○ | ○ | ○ | ○ | ○ | ○ | ○ | ○ | 0 |
| × | × | × | × | × | × | × | × | ○ | 0 |
| × | × | × | × | × | × | × | ○ | × | $1/8\,V_{THE}$ |
| × | × | × | × | × | × | ○ | × | × | $2/8\,V_{THE}$ |
| × | × | × | × | × | ○ | × | × | × | $3/8\,V_{THE}$ |
| × | × | × | × | ○ | × | × | × | × | $4/8\,V_{THE}$ |
| × | × | × | ○ | × | × | × | × | × | $5/8\,V_{THE}$ |
| × | × | ○ | × | × | × | × | × | × | $6/8\,V_{THE}$ |
| × | ○ | × | × | × | × | × | × | × | $7/8\,V_{THE}$ |
| ○ | × | × | × | × | × | × | × | × | $V_{THE}$ |

○ : NOT DISCONNECTED

× : DISCONNECTED

Fig.9

| FUSE 73 | FUSE 74 | FUSE 75 | FUSE 76 | FUSE 77 | FUSE 78 | FUSE 79 | FUSE 80 | VOLTAGE BETWEEN NODE 84 AND NODE 87 |
|---|---|---|---|---|---|---|---|---|
| ○ | ○ | ○ | ○ | ○ | ○ | ○ | ○ | $2V_{THD}$ |
| × | × | × | × | ○ | × | × | × | $2V_{THD}$ |
| × | ○ | × | × | × | ○ | × | × | $3V_{THD}$ |
| × | × | ○ | × | × | × | ○ | × | $4V_{THD}$ |
| × | × | × | ○ | × | × | × | ○ | $5V_{THD}$ |

○ : NOT DISCONNECTED

× : DISCONNECTED

SEMICONDUCTOR INTEGRATED CIRCUIT DEVICE HAVING BUILT-IN STEP-DOWN CIRCUIT FOR STEPPING DOWN EXTERNAL POWER SUPPLY VOLTAGE

This application is a continuation of application Ser. No. 08/260,915, filed Jun. 15, 1994, now abandoned.

BACKGROUND OF THE INVENTION

1. Field of the Invention

The present invention relates to a semiconductor integrated circuit device, constructed with a built-in step-down circuit, which steps down an externally supplied voltage.

2. Description of the Related Art

In a prior art semiconductor integrated circuit, for example, a dynamic random access memory (DRAM) is well-known which includes a storage circuit, an input terminal, a step-down circuit for stepping down an external power supply voltage $V_{CC}$, and an NMOS transistor.

In other words, the step-down circuit supplies a step-down voltage $V_A$ obtained at the source of an NMOS transistor to the memory circuit as an internal supply voltage, where $V_A=V_{CC}-V_{th}$, and $V_{th}$ is a threshold voltage of the NMOS transistor.

The DRAM has the problem that if there are variations due to the production processes, then variations arise in the characteristics of the NMOS transistor. In other words, variation in the step-down voltage $V_A$ and the characteristics of the memory circuit become unstable.

SUMMARY OF THE INVENTION

In light of such problems, the present invention was developed.

The present invention aims to provide a semiconductor integrated circuit in which a step-down voltage with a desired constant voltage level can be obtained even if there are variations due to the production processes, and which allows a planned stabilization of the characteristics of the internal circuits which employ the step-down voltage as a supply voltage.

In accordance with an aspect of the present invention, there is provided a semiconductor integrated circuit device comprising: a first external power supply input terminal mounted on a chip body for inputting a high-voltage-side supply voltage $V_{CC}$; a constant current source, a first terminal of which is connected with the first external power supply input terminal; a second input terminal connected with a second terminal of the constant current source for inputting a second low-voltage-side external supply voltage $V_{SS}$; a load circuit connected between the second terminal of the constant current source and the second input terminal for changing a voltage between two terminals of the load circuit variably on account of opening of fuses, wherein a step-down circuit is formed by the constant current source and the load circuit, and provides a step-down voltage $V_B$ for stepping down the high-voltage-side supply voltage $V_{CC}$ at a node for connecting the second terminal of the constant current source with the load circuit; and wherein internal circuits are connected with the node and the second input terminal, and operatively provides the step-down voltage $V_B$ in the form of the high-voltage-side supply voltage.

According to the present invention, the step-down voltage is determined by the voltage between the two terminals of the load circuit within the step-down circuit. By arranging the circuit such that the voltage between the two terminals of the load circuit can be varied by disconnecting fuses, it is possible to make the characteristics of the step-down circuit uniform and to obtain a step-down voltage of constant voltage level by disconnecting fuses provided within the load circuit. The step down voltage remains constant even if there are variations due to the production processes and if variations arise in the characteristics of the step-down circuit. Thus one can plan a stabilization of the characteristics of the internal circuits which employ the step-down voltage as a supply voltage.

BRIEF DESCRIPTION OF THE DRAWINGS

FIG. 7 is a view showing the relationship between an open/close state of fuses and a voltage at a specified node 85 in the load circuit;

FIG. 8 is a view showing the relationship between an open/close state of fuses and a voltage between nodes 85 and 86 in the voltage divider circuit;

FIG. 9 is a view showing the relationship between an open/close state of fuses and a voltage between nodes 84 and 87 in the boosting circuit.

PREFERRED EMBODIMENTS OF THE INVENTION

Figure 1:
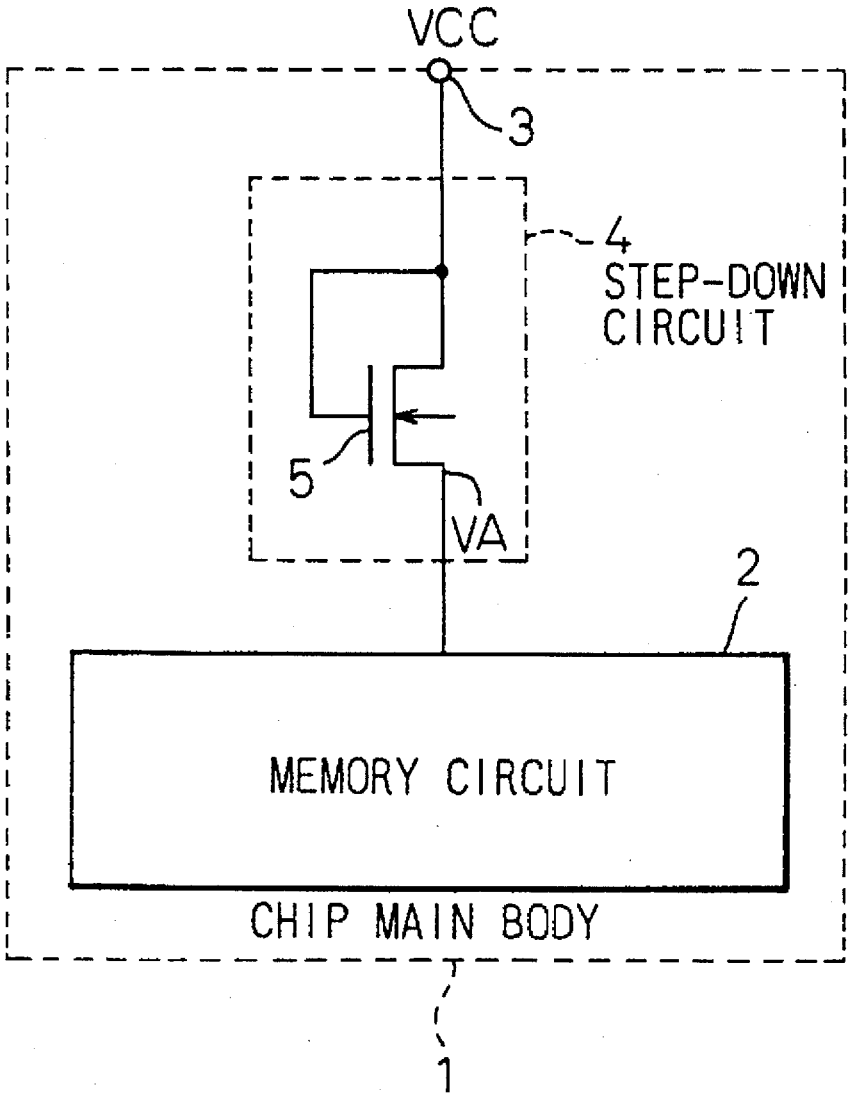
Fig. 1 (PRIOR ART)
FIG. 1 is a view showing the main components of an example of a prior art DRAM.

The present invention will be described with reference to the prior art as illustrated in FIG. 1.

FIG. 1 is a view showing a main structure of a prior art dynamic random access memory (DRAM). Reference numeral 1 is a chip body, 2 a memory circuit, 3 an external supply voltage input terminal for inputting a voltage $V_{CC}$ from an external power supply, 4 a step-down circuit which steps down the external supply voltage $V_{CC}$ input to the external supply voltage input terminal 3, 5 an NMOS transistor, and $V_A$ denotes a step-down voltage.

The step-down circuit 4 supplies the step-down voltage $V_A=V_{CC}-V_{TH}$, where $V_{TH}$ is the threshold voltage of the NMOS transistor 5, obtained at the source of NMOS transistor 5 to the memory circuit 2 as an internal supply voltage.

If there are variations due to the production processes of the DRAM, then the variations arise in the characteristics of the NMOS transistor 5, in other words, in the step-down voltage $V_A$, thus making the characteristics of the memory circuit 2 unstable.

Figure 2:
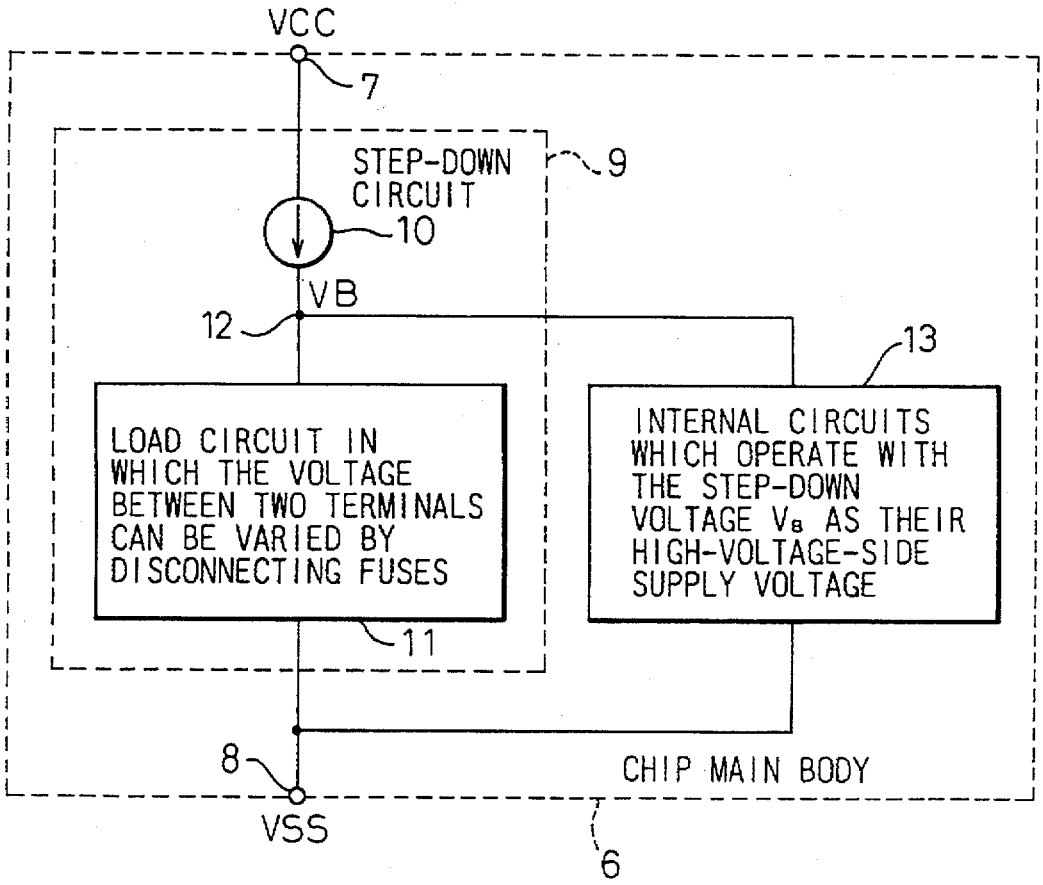
FIG. 2 is a view showing a principal structure of the present invention.

FIG. 2 is a view showing a principal structure of the present invention. In FIG. 2, reference numeral 6 denotes a chip main body, 7 an external supply voltage terminal to which the high-voltage-side external supply voltage $V_{CC}$ is input, and 8 an external supply voltage input terminal to which a low-voltage-side external supply voltage $V_{SS}$ is input.

Reference numeral 9 denotes a step-down circuit, 10 a constant current source, 11 a load circuit in which the voltage between two terminals can be varied by disconnecting fuses, and 12 is a node at which a step-down voltage $V_B$ is obtained.

Also, reference numeral 13 denotes internal circuits which operate with the step-down voltage $V_B$ provided by the step-down circuit 9 in the form of their high-voltage-side supply voltage.

Accordingly, the semiconductor integrated circuit of the present invention is constructed by providing a step-down circuit 9, which is provided with a constant current source 10 of which a first terminal is connected to an external supply voltage input terminal 7 into which a high-voltage-side external supply voltage $V_{CC}$ is input. The semiconductor integrated circuit is also constructed with a load circuit 11, which is provided between a second terminal of this constant current source 10 and an external supply voltage input terminal 8 into which a low-voltage-side external supply voltage $V_{SS}$ is input, and in which load circuit the voltage between the two terminals can be varied by disconnecting a fuse/fuses, and which step-down circuit is arranged such that a step-down voltage $V_B$, which is the stepped-down high-voltage-side external supply voltage $V_{CC}$, can be obtained at a node 12 where the second terminal of the constant current source 10 and the load circuit 11 are connected.

In the present invention, the step-down voltage $V_B$ is determined by the voltage between the two terminals of the load circuit 11, but it is arranged in that the voltage between the two terminals of this load circuit 11 can be varied by disconnecting fuses.

As a result, even if there are variations due to the production processes, and variations in the characteristics of the step-down circuit 9 arise, the characteristics of the step-down circuit 9 can be made uniform by disconnecting fuses provided in the load circuit 11, and a step-down voltage $V_B$ of the desired constant voltage level can be obtained.

Figure 3:
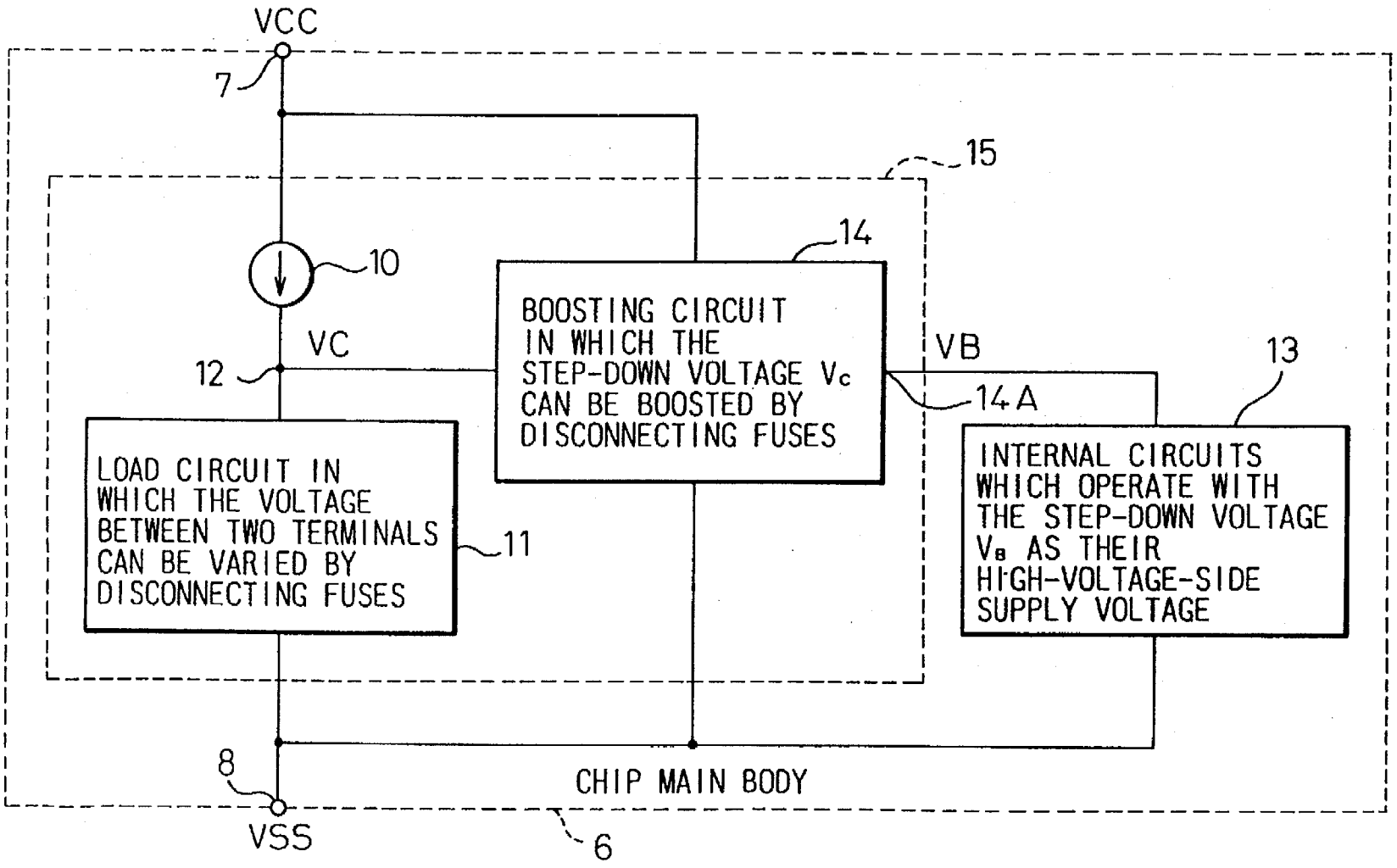
FIG. 3 is a view showing another structure of the present invention.

Moreover, as shown in FIG. 3, it is also possible to have a construction having a step-down circuit 15 in which a step-down voltage $V_C$ ($<V_B$) is obtained at a node 12, a boosting circuit 14 which boosts this step-down voltage $V_C$ is provided, and a step-down voltage $V_B$ is obtained at the output terminal 14A of this boosting circuit 14.

For example, if in this case the load circuit 11 is constructed using an enhancement-type NMOS transistor, and it is arranged such that the step-down voltage $V_C$ is obtained using the threshold voltage of this enhancement-type NMOS transistor, and the step-down voltage $V_B$ is obtained by boosting the step-down voltage $V_C$ using a depletion-type NMOS transistor in the boosting circuit 14, then the step-down circuit 15 can be made to have satisfactory temperature characteristics.

An embodiment of the present invention is described below with reference to FIG. 4 to FIG. 6, taking for an example a case in which the present invention is applied to DRAM.

Figure 4:
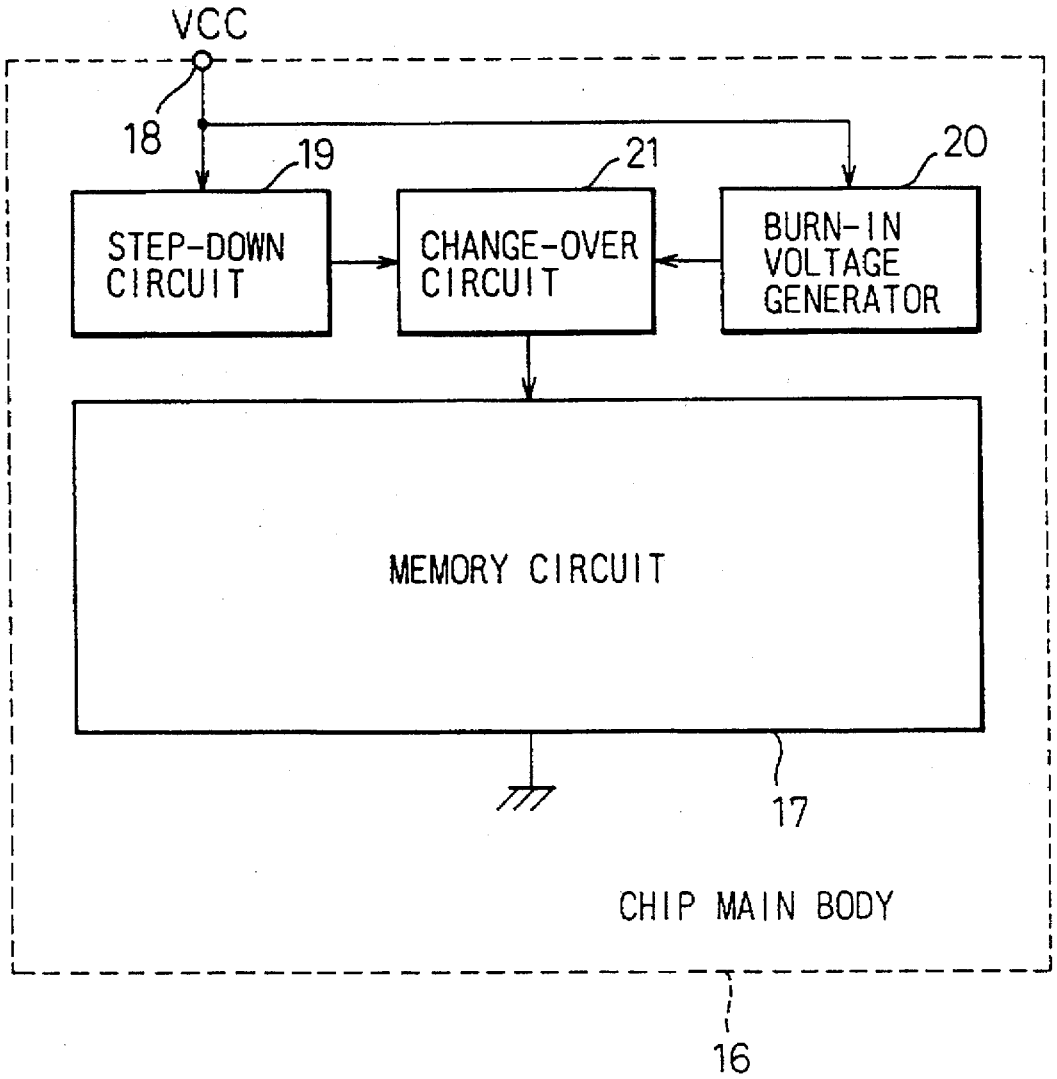
FIG. 4 is a view showing the main components in an embodiment of the present invention.

FIG. 4 is a block diagram showing the main components of an embodiment of the present invention. In FIG. 4, 16 is the chip main body, 17 is a memory circuit, and 18 is an external supply voltage input terminal to which an external supply voltage $V_{CC}$ is input.

Also, 19 is a step-down circuit which steps down the external supply voltage $V_{CC}$ input to the external supply voltage input terminal 18, and 20 is a burn-in voltage-generating circuit which generates a burn-in voltage.

Further, 21 is a change-over circuit (regulator) which, during normal operation, supplies the step-down voltages, output from the step-down circuit 19, to the memory circuit 17 as a supply voltage and, during burn-in testing, converts the burn-in voltage output from the burn-in voltage generating circuit, for example from 7 [V] to 4.5 [IV], and supplies this to the memory circuit 17 as a supply voltage.

Figure 5:
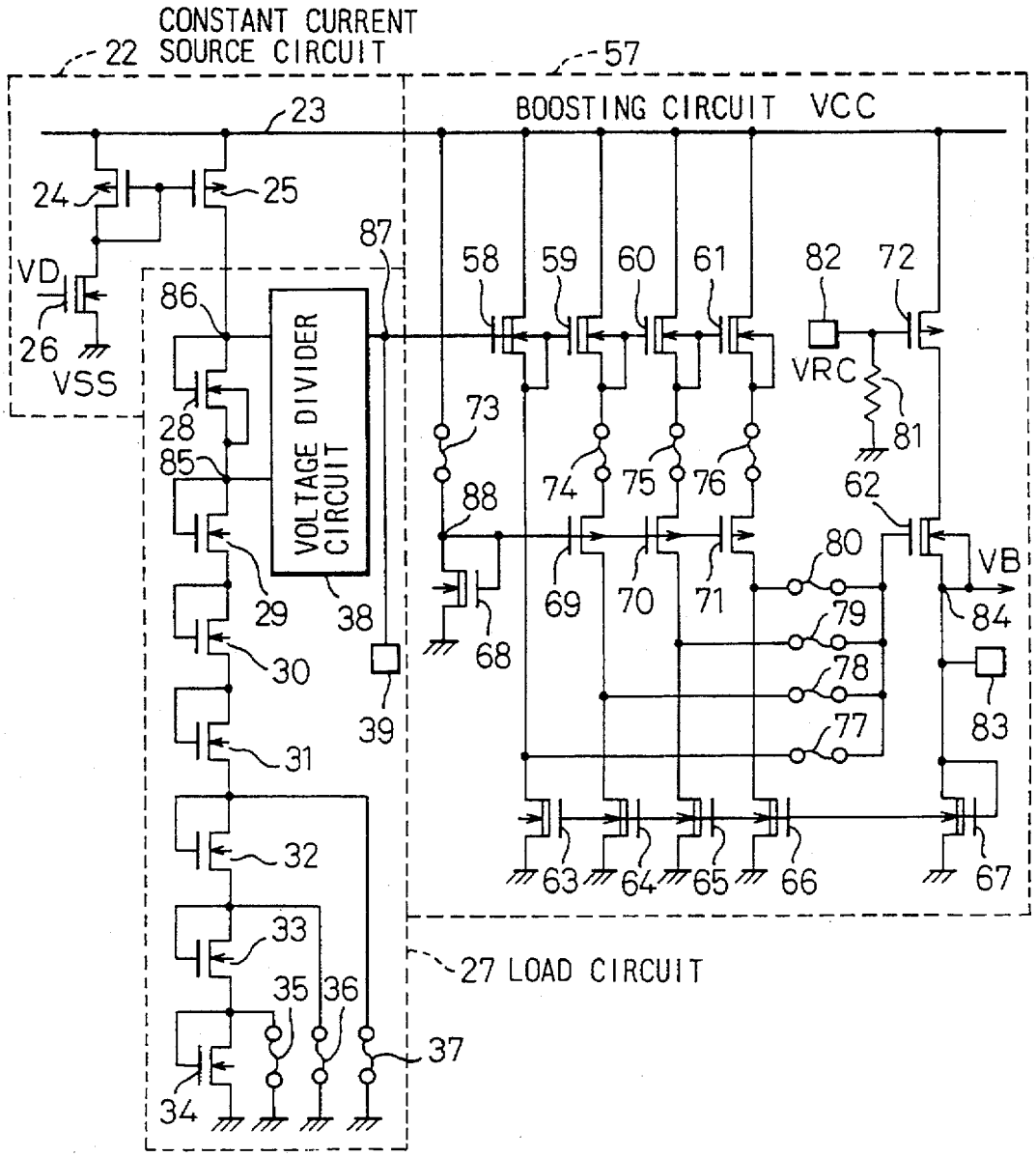
FIG. 5 is a circuit diagram showing a step-down circuit including a constant current source circuit, a load circuit and a boosting circuit according to the present invention.

Here, the step-down circuit 19 is constructed as shown in FIG. 5. In the diagram, 22 is a constant current source circuit, 23 is a $V_{CC}$ power supply line which supplies an external supply voltage $V_{CC}$, and 24 and 25 are PMOS transistors which constitute a current mirror circuit.

Further, 26 is a depletion-type NMOS transistor which determines the current flowing into the PMOS transistor 24 and 25, and $V_D$ is the step-down voltage output by the step-down circuit 19, which voltage, in this embodiment, is also employed as the bias voltage for the NMOS transistor 26.

Further, reference numeral 27 is a load circuit for the constant current source circuit 22, 28 to 34 are enhancement-type NMOS transistors in which the gates are connected to the drains, i.e., diodes, fuses 35 to 37 can be disconnected or opened by using a laser device as a fuse trimmer.

Figure 6:
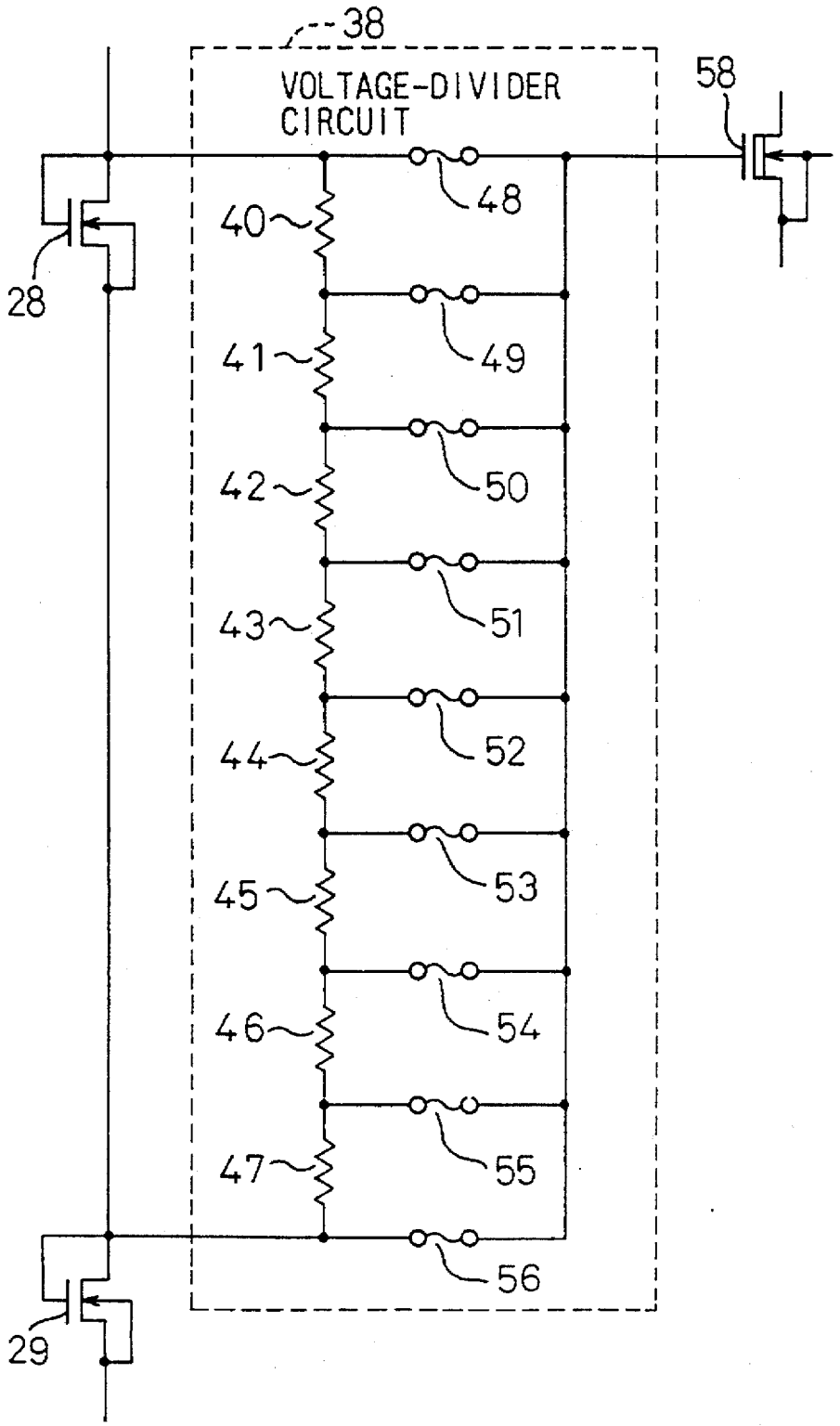
FIG. 6 is a circuit diagram showing a voltage divider circuit in FIG. 5.

Also, reference numeral 38 is a voltage-divider circuit which performs voltage division by means of resistors, and 39 is a testing pad (electrode) arranged such that a test probe can be brought into contact with it; the voltage-divider circuit 38 is constructed as shown in FIG. 6. In FIG. 6, 40 to 47 are resistors, and 48 to 56 are fuses which can be disconnected or opened by using a laser device.

Further, in FIG. 5, 57 is a boosting circuit, 58 to 68 are depletion-type NMOS transistors, 69 to 72 are PMOS transistors, 73 to 80 are fuses which can be opened by using a laser device, 81 is a resistor, and 82 and 83 are testing pads arranged such that a test probe can be brought into contact with them.

Moreover, in this step-down circuit 19, the arrangement is such that the step-down voltage $V_B$ is obtained at the source of the NMOS transistor 62, or at a node 84.

Here, the relationship between the state of disconnection or open state of the fuses 35 to 37 in the load circuit 27, and the voltage at the node 85 is shown in FIG. 7. It should be noted that $V_{THE}$ is the threshold voltage of the enhancement-type NMOS transistor, a symbol "0" indicates a closed state, and a symbol "X" indicates an open state. This is also the case in FIG. 8 and FIG. 9.

FIG. 8 is a view showing the relationship between an open/closed state of fuses 48 to 56 in the voltage divider circuit 38 and a voltage between a node 86 and a node 85.

Further, FIG. 9 is a view showing the relationship between an open/closed state of fuses 73 to 80 in the boosting circuit 57 and a voltage between a node 84 and a node 87, where $V_{THD}$ is a threshold voltage of a depletion type NMOS transistor.

Therefore, by disconnecting fuse 73 and selectively opening certain fuses among fuses 35 to 37, 48 to 56 and 74 to 80, it is possible to obtain $3V_{THE}+2V_{THD}$, $3V_{THE}+1/8V_{THE}+2V_{THD}$, $3V_{THE}+2/8V_{THE}+2V_{THD}$, . . . , $6V_{THE}+7/8V_{THE}+5V_{THD}$, $6V_{THE}+V_{THE}+5_{THD}$ as the step-down voltage $V_B$.

Thus, in this embodiment according to FIG. 5; the desired step-down voltage $V_B$ is obtained by disconnecting fuse 73 and selectively disconnecting fuses 35 to 37, 48 to 56 and 74 to 80, in the following way.

That is to say during wafer testing, external supply voltages $V_{CC}$ and $V_{SS}$ are first applied in the LSI testing device (LSI tester). In this case, node 88 is at a HIGH level, and the PMOS transistors 69 to 71 are set to the OFF state.

If the PMOS transistors 69 to 71 are not set to the OFF state in this way, then the output voltage of the NMOS transistor 61 is recirculated to the gate of the NMOS transistor 59 via the fuses 80 and 77, and the operation becomes unstable accordingly.

In this case, the pad 82 is set to a state in which no voltage at all is applied to it. As a result, the gate voltage of the PMOS transistor 72 is $V_{SS}$, and this PMOS transistor 72 is set to the ON state.

Then, under such conditions, the voltage at the pad 39 and the voltage at the pad 83 are measured.

Here, it is possible to find the threshold voltage $V_{THE}$ of the enhancement-type NMOS transistors 29 to 31, in other words, the threshold voltage $V_{THE}$ of the enhancement-type NMOS transistors 28 to 34, from the value of "the voltage at the pad 39÷3 (the number of enhancement-type NMOS transistors 29 to 31)".

It is also possible to find the threshold voltage $V_{THD}$ of the depletion-type NMOS transistor 58, in other words, the threshold voltage $V_{THD}$ of the depletion-type NMOS transistors 58 to 61, from the value of "the voltage at the pad 83 in the boosting circuit 57—the voltage at the pad 39 in the load circuit 27".

It is next arranged that no voltage is output by the step-down circuit 19 at the source of the depletion-type NMOS transistor 62, in other words at the node 84, by applying a positive voltage $V_{RC}$ to the pad 82, setting the PMOS transistor 72 to the OFF state.

A voltage that is the same as the step-down voltage $V_B$ which should essentially be obtained from the step-down circuit 19, is then applied to the pad 83, the memory circuit 17 (see FIG. 4) is tested, and the addresses which should be made redundant are determined.

The device according to this embodiment is next transferred to an external trimming device (fuse disconnecting device), the fuse 73 is disconnected, and the fuses 35 to 37, 48 to 56 and 74 to 80 are selectively disconnected, by taking into consideration the measured threshold voltage $V_{THE}$ and $V_{THD}$, such that the step-down voltage $V_B$ has the desired voltage level, and the fuses necessary to perform the redundancy operation are also disconnected.

Moreover, by disconnecting the fuse 73, the node 88 is set to the LOW level during operation, and the PMOS transistors 69 to 71 are set to the ON state.

In the above way, according to this embodiment, the desired step-down voltage $V_B$ can be obtained by disconnecting the fuse 73 and selectively disconnecting the fuses 35 to 37, 48 to 56 and 74 to 80, and stabilization of the memory circuit 17 characteristics can be performed, even if there are variations due to the production processes and variations arise in the characteristics of the enhancement-type NMOS transistors 28 to 34 and the depletion-type NMOS transistors 58 to 62.

Moreover, according to this embodiment, pads 39 and 83 are provided, and it is arranged that by measuring the voltages at these pads 39 and 83 it is possible to find the threshold voltage $V_{THE}$ of the enhancement-type NMOS transistors 28 to 34 and the threshold voltage $V_{THD}$ of the depletion-type NMOS transistors 58 to 62, and thus highly accurate adjustment of the step-down voltage $V_B$ can be performed.

Also, in this embodiment, a pad 82 is provided for applying the voltage $V_{RC}$ to set the PMOS transistor 72 to the OFF state, and it is arranged that, by setting the PMOS transistor 72 to the OFF state, no voltage is output from the step-down circuit 19 during testing of the memory circuit 17, and that the voltage required for the memory circuit 17 is supplied from the pad 83.

As a result it is possible, in the LSI testing circuit, to measure the voltages at the pads 39 and 89 in order to find the threshold voltage $V_{THE}$ of the enhancement-type NMOS transistors 28 to 34 and the threshold voltage $V_{THD}$ of the depletion-type NMOS transistors 58 to 62, to test the memory circuit 17, and then to disconnect the fuses to obtain the step-down voltage $V_B$, and disconnect the fuses necessary to carry out the redundancy, and thus the testing process and the trimming process can be performed efficiently.

Incidentally, if the pad 82 is not provided it is necessary to carry out the processes in the following order, and the wafer must be moved beyond what is necessary: measurement in the LSI testing device of the voltages at the pads 39 and 83 to find the threshold voltages $V_{THE}$ and $V_{THD}$→disconnection in the trimming device of the fuses to obtain the step-down voltage $V_B$→testing in the LSI testing device of the memory circuit 17→disconnection in the trimming device of the fuses necessary for the redundancy.

Moreover, in disconnecting the fuses to obtain the step-down voltage $V_B$, it is preferable, from the point of view of temperature characteristics, for the selective disconnection of the fuses 35 to 37 and 74 to 80 to be performed such that the difference between the number of transistors which are ultimately used from amongst the enhancement-type NMOS transistors 28 to 34, and the number of transistors which are ultimately used from amongst the depletion-type NMOS transistors 58 to 62, is small, and if possible the numbers should be the same.

We claim:

1. A step down circuit, comprising:

a voltage source;

a constant current source having a current output; and a load circuit connected to the current output and to said voltage source, said load circuit comprising:

a first resistor connected to said current source forming a first resistor node;

a second resistor connected in series to said first resistor forming a second resistor node;

a first fuse connected to the first resistor node and to a voltage output;

a second fuse connected between the second resistor node and the voltage output;

first and second diodes connected in series at a diode node, said series connected diodes connected between the current output and said voltage source;

a third fuse connected in parallel with said series connected diodes and between the current output and said voltage source; and a fourth fuse connected in parallel with the second diode of said series connected diodes and between said diode node and said voltage source.

2. The step down circuit according to claim 1, wherein said first fuse in said load circuit can be selectively disconnected by a trimming means to thereby vary a terminal voltage of the connection of said load circuit to said current source.

3. The step down circuit according to claim 1, further comprising:

a boosting circuit for boosting a second step down voltage $V_c$ which is a stepped down voltage of a high-voltage-side external supply voltage $V_{cc}$ obtained at a node connecting said constant current source to said load circuit.

4. The step down circuit according to claim 3, wherein a step-down voltage $V_B$ is provided at an output of said boosting circuit.

5. The step down circuit according to claim 4, wherein an internal circuit is connected to the output of said boosting circuit and an input terminal and receives said first step-down voltage $V_B$ in the form of a high-voltage-side supply voltage.

6. A step down circuit, comprising:

a voltage source;

a constant current source having a current output;

a load circuit connected to the current output and to said voltage source, said load circuit comprising:

a first resistor connected to said current source forming a first resistor node;

a second resistor connected in series to said first resistor forming a second resistor node;

a first fuse connected to the first resistor node and to a voltage output;

a second fuse connected between the second resistor node and the voltage output;

first and second diodes connected in series at a diode node, said series connected diodes connected between the current output and said voltage source;

a third fuse connected in parallel with said series connected diodes and between the current output and said voltage source; and a fourth fuse connected in parallel with the second diode of said series connected diodes and between said diode node and said voltage source; and a boosting circuit connected to a first external power supply input terminal, a second external power supply input terminal, and the diode node for outputting a boosted voltage received from said diode node at an output node.

7. The voltage step down circuit, comprising:

a first voltage source providing a first supply voltage;

a second voltage source providing a second supply voltage lower than said first supply voltage;

a constant current source connected between said first and second voltage sources and outputting a constant current at an output terminal;

a load circuit connected between the output terminal of said constant current source and said second voltage source, said load circuit comprising:

a first diode having an input forming a first diode node;

a second diode serially connected to said first diode forming a second diode node and connected to said second voltage source;

a first fuse connected between the first diode node and said second voltage source;

a second fuse connected between the second diode node and said second voltage source; and a voltage divider circuit connected between the output terminal of said constant current source and said first diode node, said voltage divider circuit comprising:

a first resistor connected to said output terminal of said constant current source forming a first resistor node;

a second resistor serially connected to said first resistor forming a second resistor node;

a first fuse connected between the first resistor node and the first diode node; and a second fuse connected between the second resistor node and the first diode node.

* * * * *

UNITED STATES PATENT AND TRADEMARK OFFICE

CERTIFICATE OF CORRECTION

PATENT NO. : 5,675,280

DATED : October 7, 1997

INVENTOR(S) : NOMURA et al.

It is certified that error appears in the above-identified patent and that said Letters Patent is hereby corrected as shown below:

Title Page, [73] Assignee, change "FUJITSU LIMITED, Kawasaki, Japan" to --FUJITSU LIMITED, Kawasaki and FUJITSU VLSI LIMITED, Kasugai, both of Japan--.

Col. 1, line 29, change "variation" to --variations arise--.

Col. 2, line 8, after "Thus" insert --,--.

Col. 4, line 4, change "[IV]" to --[V]--;
line 20, change "diodes, fuses" to --diodes. Fuses--;
line 60, change ";" to --,--;
line 65, change "applied" to --supplied--.

Signed and Sealed this

Seventeenth Day of March, 1998

*Attest:*

Bruce Lehman

BRUCE LEHMAN

*Attesting Officer*

*Commissioner of Patents and Trademarks*